US005086566A

United States Patent [19]

Klumpp

[11] Patent Number: 5,086,566

[45] Date of Patent: Feb. 11, 1992

[54] ADJUSTABLE TELESCOPIC SIGHT MOUNT

[75] Inventor: Harry R. Klumpp, Southgate, Calif.

[73] Assignee: Fontaine Industries, Long Beach, Calif.

[21] Appl. No.: 611,927

[22] Filed: Nov. 9, 1990

[51] Int. Cl.[5] ..... F41G 1/38

[52] U.S. Cl. ..... 33/247; 33/254; 42/101

[58] Field of Search ..... 33/247, 248, 252, 254, 33/257, 233, 245, 258, 260; 42/100, 101

[56] References Cited

U.S. PATENT DOCUMENTS

| | | | |
|---|---|---|---|
| 541,559 | 6/1895 | Lyman | 33/257 |
| 1,117,782 | 11/1914 | Camus | 33/247 |
| 2,018,961 | 10/1935 | Kuhn | 42/100 |
| 2,237,395 | 4/1941 | Sweet | 33/248 |
| 2,583,260 | 1/1952 | Felix | 33/245 |
| 2,585,395 | 2/1952 | Martin et al. | 33/258 |
| 2,774,142 | 12/1956 | Lake et al. | 33/247 |
| 2,857,675 | 10/1958 | Kesselring | 33/245 |
| 3,414,221 | 12/1968 | Nelson | 33/247 |
| 4,216,600 | 8/1980 | Brueckner et al. | 42/101 |
| 4,920,654 | 5/1990 | Sanders | 33/252 |

FOREIGN PATENT DOCUMENTS

| | | | |
|---|---|---|---|
| 13444 | of 1885 | United Kingdom | 33/248 |

*Primary Examiner*—Allan N. Shoap
*Assistant Examiner*—C. W. Fulton
*Attorney, Agent, or Firm*—Fulwider, Patton, Lee & Utecht

[57] ABSTRACT

A telescopic sight mount includes means to provide vertical and lateral adjustment of the telescopic sight relative to the weapon bore, the adjustment means including clevis and blade means operations for vertical adjustment and set screw means operation for lateral adjustment of rings enclosing the telescopic sight.

3 Claims, 2 Drawing Sheets 2
4
6
8
10
12
14
16
18
20
22
24
26
28
30
32
34
36
38
40
42
44
46
3
3

ADJUSTABLE TELESCOPIC SIGHT MOUNT

BACKGROUND OF THE INVENTION

1. Field of the Invention

This invention relates to gun sights for weapons and specifically for telescopic sight mounts.

2. Description of Related Art

Telescopic sights for use on rifles and other weapons are well known and have gained wide acceptance. The adaptability of such telescopic sights to weapons generally involves the mounting of the telescope containing cross hairs which are used to register upon the target and a means of mounting the telescope onto the weapon. Generally, it has been known in the art to mount such a sight by the use of rings which encircle the telescope and mount onto a dovetail-like apparatus which is parallel to the bore of the weapon. In conventional systems, the rings which encircle the telescope are solidly mounted to a base which connects them to longitudinal dovetails (or rails) on the weapon. In some applications, the rings or ring mounts may also contain set screws or adjustment screws which allow for horizontal and vertical adjustment of the telescope to accommodate lateral and vertical changes in the sight line of the telescope versus the weapon bore. In other arrangements known in the art, micrometer adjustment to the cross hairs within the telescope may be made in order to adjust for windage and elevation to "sight in" the weapon at a target range after the telescopic sight has been mounted. However, in many applications, it is desirable to have the ability to accommodate large excursions of elevation which are not easily provided by micrometer adjustments or adjustments in the base, since the base is commonly mounted to a linear track or dovetail arrangement on the weapon. It would, therefore, be desirable if a telescopic mount could be provided which allowed for vertical and horizontal adjustment to accommodate initial "sighting in" of the weapon before minor adjustments are made with the micrometer sights on the telescope.

SUMMARY OF THE INVENTION

The present invention is designed to address the problem of gross misalignment of a telescopic sight with the sight mount, particularly when larger than usual excursions in elevation and windage are to be accommodated without using the full extent of the micrometer windage and elevation adjustments on the telescopic mount. The invention accomplishes this desirable end by providing a vertically adjustable forward mounting ring which includes a slot cut into the mount for the front ring, the slot being arranged perpendicular to the bore of the weapon and extending vertically to allow for adjustment on the set screw which passes through the slot and engages a fork arrangement constraining the vertical mount. Also incorporated into an adjustment ring is a pin which includes a groove which is engaged on opposite sides by movable set screws which allow for lateral movement of the pin on the mount, thereby accommodating gross changes in windage adjustment. These features are combined in an otherwise conventional telescopic sight mounting base which may be used with either a dovetail arrangement or Weaver-type base, which is well known in the art. In one embodiment, the vertical and lateral adjustment apparatus may be combined in a single ring mount.

A further feature of the invention includes means, which may be a combination of convex and concave members mating with one another and attached to the base and ring mount, respectively, for adjusting the rotational alignment of the ring mount with the base.

From the above, it may be seen that the present invention provides for a means for allowing major adjustments in the vertical and lateral alignment of a telescopic sight with the bore of a weapon, without using the microscopic adjustments provided with the sight to function as windage and elevation during the fine adjustment of the sighting in process. Other features and benefits of the invention will become obvious to those skilled in the art upon review of the drawings and description of the preferred embodiment which illustrate, by way of example, features of the invention.

DESCRIPTION OF THE PREFERRED EMBODIMENT

The present invention provides a means to accommodate gross increases in elevation and windage for a telescopic sight for a weapon. By use of the invention, the micrometer adjustments normally provided to the telescopic sight for elevational and windage may be used only for the "sighting in" of the weapon and not for the gross alignment of the weapon with the weapon bore. The invention is particularly advantageous for the initial sighting in of a telescopic sight when the weapon is to be targeted for a range of targets representing large elevations or deflections compared with the bore sight.

Figures 1, 2, 3, 4:
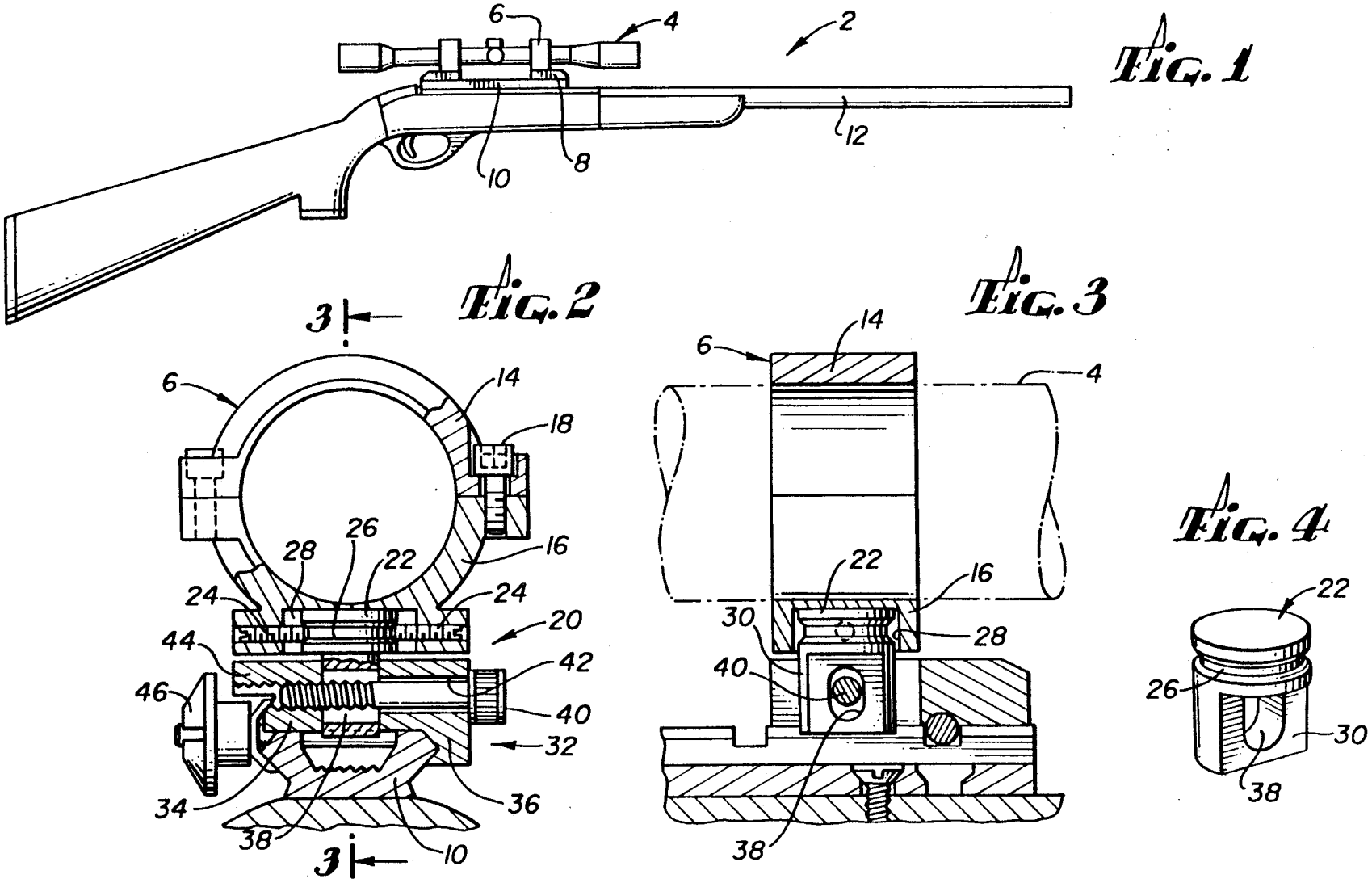
FIG. 1 is a side view of a rifle incorporating a telescopic sight and sight mounts.
FIG. 2 is a cross-sectional view of a telescopic sight mount according to the invention.
FIG. 3 is a lateral cross-sectional view at 3—3 of FIG. 2 illustrating the arrangement of the vertical adjustment mechanism of the invention.
FIG. 4 is a perspective view of the adjusting pin incorporated in the sight mount of the present invention.

FIG. 1 illustrates a weapon 2 including a telescopic sight 4 mounted by means of mounting rings 6 attached by ring bases 8 to a mounting base 10 which is attached to the weapon and is essentially parallel with the bore of the barrel 12.

Referring to FIG. 2, sight ring 6 consists of upper and lower halves 14 and 16, respectively, which are fastened together by fasteners 18 and further include a ring base 20 which incorporates an internal pin 22 used to accommodate vertical and horizontal alterations in the position of scope ring 6. Pin 22 is retained in the base by set screws 24 operating in threaded bores extending laterally in the ring base. Pin 22 includes a groove 26 which receives the set screw and operates within a cut-out area 28 in the ring base to allow for lateral movement of the pin within the ring base in response to adjustment of set screws 24. Pin 22 also includes a vertical extension blade 30 which is received in a clevis 36 including jaws 34 and 36. The blade 30 further includes a vertical slot 38 designed to allow vertical movement of the blade within the clevis. Once the desired position of the blade within the clevis is reached, fastener 40, which extends through bore 42 in the clevis and is received in threaded portion in the opposing jaw 44, is then tightened to retain the ring 6 in the desired vertical position. The entire assembly is mounted on to a conventional mounting base 10 usually made in the form of an extrusion and locked via set screw 46 which engages the corresponding portions of the base and ring mount. In the embodiment illustrated, the so-called "Weaver mount" is illustrated although other mounting systems, such as those used on 0.22 caliber rifles and the like, may be used with the invention.

Referring to FIG. 3, ring mount 6 receives pin 22 in slot 28 which is sized fore and aft to receive pin 22 with some degree of looseness in order to allow for changes in alignment as the pin is moved vertically around fastener 40. Blade 30 includes slot 38, as previously described, in order to allow for the vertical movement.

FIG. 4 is a perspective view of pin 22 illustrating the groove 26 formed in the pin to receive the end of set screws 24. A slot 38 is formed in blade 30 to allow for the accommodation of vertical movement of the ring for adjustment as described above.

Figure 5:
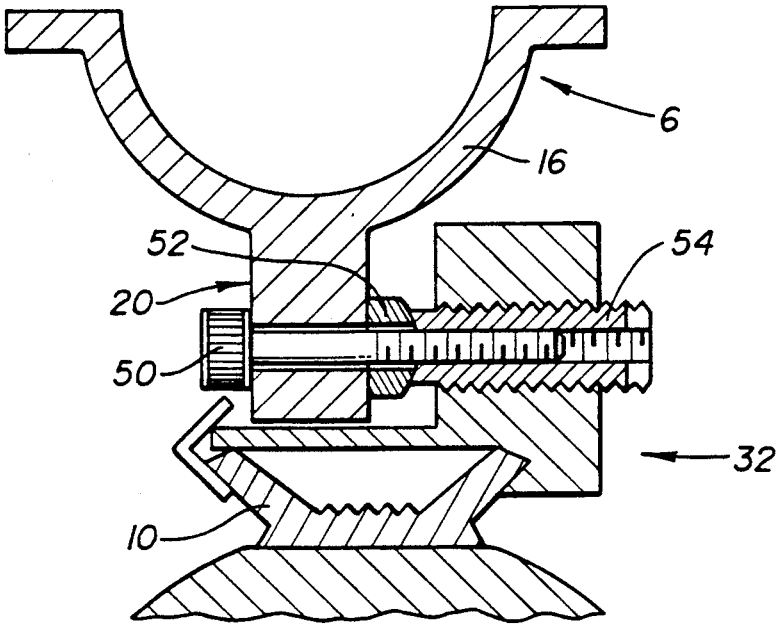
FIG. 5 is a cross sectional view of an alternative embodiment of the mount of the invention which allows for the accommodation of rotation of the sight monitoring rings.

FIG. 5 illustrates a further feature of the invention which allows for the accommodation of rotation of the sight rings. In this aspect of the invention, the ring base 20 is mounted with fastener 50 and convex washer 52 to base mount 32 via concave insert 54, which in combination with convex washer 52, allows for the rotation of ring 16 relative to mounting base 10.

From the above, it can be seen that the present invention provides an efficient and novel means of allowing for relatively large adjustments in telescopic sights relative to the base of a weapon. While a particular form of invention has been illustrated and described, it will be apparent that various modifications can be made without departing from the spirit and scope of this invention. Accordingly, it is not intended that the invention be limited, except as by the appended claims.

What is claimed is:

1. A telescopic sight mount which includes a mounting base, said base including means to mount said mounting base upon linear rail means attached to a weapon; said mount further including front and rear ring mounts, at least one of said ring mounts including a clevis, said clevis further including a lateral bore in one jaw of said clevis and threaded bore in the opposing jaw of said clevis, said bore and said threaded portion being aligned with one another and perpendicular to said rail means, said base further including means to laterally adjust at least one of said rings by means of set screws operative on a portion of said rings; and ring mount adjusting means, including a vertical blade designed to be received in the jaws of said clevis, said blade further including a slot operative to allow vertical adjustment of said ring within said clevis, said blade being retained in said clevis by fastening means extending through a first jaw of said clevis and engaging the threaded portion of a second jaw of said clevis.

2. The sight mount of claim 1, wherein said set screws operate to adjust said blade laterally in said mount.

3. The sight mount of claim 1, further comprising means to rotatably adjust at least one of said ring mounts relative to said mounting base.

* * * * *